United States Patent [19]

Funk

[11] 4,164,451

[45] Aug. 14, 1979

[54] PRESSURE RESPONSIVE FRACTIONATION CONTROL

[75] Inventor: Gary L. Funk, Bartlesville, Okla.

[73] Assignee: Phillips Petroleum Company, Bartlesville, Okla.

[21] Appl. No.: 912,690

[22] Filed: Jun. 5, 1978

[51] Int. Cl.[2] ..... F25J 3/02

[52] U.S. Cl. ..... 203/2; 23/230 A; 364/501; 422/112

[58] Field of Search ..... 23/230 A; 422/62, 112; 203/1, 2; 364/501

[56] References Cited

U.S. PATENT DOCUMENTS

| | | | |
|---|---|---|---|
| 2,917,437 | 12/1959 | Kleiss et al. | 202/160 |
| 2,939,293 | 6/1960 | Green | 62/19 |
| 3,208,230 | 9/1965 | Fourroux | 62/21 |
| 3,238,111 | 3/1966 | Harper | 203/2 |
| 3,322,650 | 5/1967 | Hillburn | 203/1 |
| 3,342,702 | 9/1967 | Rijnsdorp | 203/2 |
| 3,803,002 | 4/1974 | Skraba et al. | 203/2 X |
| 3,830,698 | 8/1974 | Kleiss | 203/2 |
| 4,070,172 | 1/1978 | Smith et al. | 203/2 |

OTHER PUBLICATIONS

Buss et al., "Modern Control Concepts for Gas Processing Plants," Presented at 54th Ann. GPA Convention, Mar. 10–12, 1975, Houston, Texas.

*Primary Examiner*—R. E. Serwin

[57] ABSTRACT

In a fractionation system in which pressure fluctuations within the fractionation vessel can result in alteration of the fractionator product composition, fractionation column pressure is monitored and converted to a temperature requirement signal representative of the temperature required within a preselected portion of the fractionation column in order to provide the desired product constituent distribution. The temperature requirement signal is utilized to provide a required heat signal which is representative of the direction and magnitude of any change necessary in the heat input to the fractionation column to maintain the required temperature. The heat input to the fractionation column is controlled in response to the required heat signal, corrected as necessary by actual analysis of the product.

30 Claims, 5 Drawing Figures

PRESSURE RESPONSIVE FRACTIONATION CONTROL

This invention relates to an apparatus and method for controlling the operation of a fractionation column in response to the pressure within the column. In another aspect this invention relates to an apparatus and method for providing stable control of a fractionation vessel in which the composition of a fractionation product can be altered by a fluctuation in pressure within the vessel. In yet another aspect this invention relates to an apparatus and method for control of the temperature in a preselected location within a fractionation column in response to measurement of the column pressure. In still another aspect, this invention relates to apparatus and method for providing a required heat signal representative of the direction and magnitude of any change necessary in the heat input to the fractionation column in response to the pressure in the fractionation column. In still another aspect, this invention relates to apparatus and method for biasing or trimming the required heat signal in response to an analysis of at least one column product. In still another aspect, this invention relates to apparatus and method for controlling the temperature in a preselected location within a fractionation column without the use of a temperature controller or a measurement of the actual temperature in the preselected location. In still another aspect, this invention relates to an apparatus and method for control of a demethanizer column associated with a natural gas liquids recovery process.

In the operation of any fractionation process there are numerous process variables which can cause an alteration of the composition of one or more of the fractionation product streams. One variable which can cause such disruption is the pressure within the fractionation column. While the pressure within the fractionation vessels of some fractionation processes may not ordinarily change so rapidly that analysis of the fractionation column product in question cannot be used to alter the column operating charateristics to avoid unwanted product composition changes, other processes are subject to relatively rapid pressure fluctuations which are a potential cause of instability in control of the fractionator product by use of automatic product analysis techniques alone.

In the demethanizer columns of natural gas liquids plants, for example, there are many sources of process upsets which result in rapid changes in the operating pressure of the column. In such systems product variation can result from pressure changes caused by a wide range of causes ranging from such seemingly insignificant events as a pipeline scraper or "pig" arriving in the line supplying natural gas to the process and similar disturbances to events certain to cause a substantial change in demethanizer column pressure such as failure of a compressor or expander associated with the process Some of the previous control systems for liquid natural gas plants provide generation of a column bottom temperature set point signal in response to the output of an analyzer-controller with the output of the analyzer-controller being determined by the difference, or error, between the measured chromatographic analysis of the bottom product and a desired bottom product analysis. The control response of a cryogenic demthanizer to disturbances in bottom product composition using this system is relatively slow for the typical control application since a long time delay is associated with the mechanical and process equipment, there are inherent time delays in the conversion of disturbances within the column to changes in composition of the bottom product, and corrective action cannot be initiated any more frequently than permitted by the sampling rate of the chromatographic analyzer.

In an effort to improve the control response more recent systems have utilized measurements of pressure in the fractionation column to provide a signal representative of the temperature required within a preselected portion of the fractionation column in order to provide the desired bottom product. This signal was corrected as necessary by actual analysis of the product and was compared to the actual temperature in the fractionation column by temperature controller. The signal resulting from the comparison was utilized to control the heat input to the fractionation column. This resulted in an improved system response over prior systems which used only product analysis for control but the system response was still slower than desired because of the response time of the temperature controller which is a second order system.

Accordingly, an object of the invention is to provide an apparatus and method for controlling the operation of a fractionation column in response to the pressure within the column. Another object of the invention is to provide an apparatus and method for implementing stable control of a fractionation vessel in which the composition of a fractionation product can be altered by a fluctuation in temperature within the vessel. Yet another object of the invention is to provide an apparatus and method for control of the temperature in a preselected location within a fractionation column in response to measurement of the column pressure. Another object of this invention is to provide apparatus and method for providing a required heat signal representative of the direction and magnitude of any change necessary in the heat input to the fractionation column in response to the pressure in the fractionation column. In still another aspect this invention relates to apparatus and method for biasing or trimming the required heat signal in response to an analysis of at least one column product. In still another aspect this invention relates to apparatus and method for controlling the temperature in a preselected location within a fractionation column without the use of a temperature controller or a measurement of the actual temperature in the preselected location. Still another object of the invention is to provide an apparatus and method for control of a demethanizer column associated with a natural gas liquids recovery process.

In accordance with the present invention the pressure within the fractionation column is used to provide a required heat signal representative of the direction and magnitude of any change necessary in the heat input to the fractionation column to maintain a fractionation column temperature necessary to provide a desired product stream composition. The required heat signal is utilized to provide fast changes in the heat input to the fractionation column in response to pressure fluctuations in the fractionation column. The required heat signal is trimmed and corrected as necessary by an analysis of at least one column product. This is accomplished by converting the product analysis directly to a required heat correction signal. A function generator rather than a temperature controller is used to provide the required heat correction signal. Thus the use of a temperature controller is completely bypassed and the system response to pressure fluctuations is improved over those systems in which temperature controllers are utilized in the fractionation column control system.

In a presently preferred embodiment of the invention the heat flow to the reboiler of a fractionation column is manipulated to provide a desired column bottom product composition. In particular, the bottom product composition is preferably expressed in terms of the proportion or ratio in which key product constituents are found. The control system of the invention increases the rapidity of the response of a fractionating column as well as increasing the effectiveness of the fractionating column control system.

As applied to a natural gas liquids separation facility, the apparatus and method of the invention are preferably utilized to control the methane to ethane ratio in the bottom product of a demethanizer column by manipulating the rate of heat input to a reboiler associated with the column. The column pressure is utilized to provide a temperature requirement signal representative of the temperature required to achieve a desired or specified methane to ethane ratio in the natural gas liquid bottom product of the demethanizer column. The temperature requirement signal is processed by a function generator to provide a required heat signal representative of the direction and magnitude of any changes in the heat input to the fractionation column necessary to maintain the required temperature. A bias signal for the required heat signal is provided by using a function generator to convert an actual analysis of the fractionation column product to a required heat correction signal. This control arrangement differs signficantly from previous systems in that the heat input to the fractionation column is controlled without the use of a temperature controller to compare an actual temperature and a required temperature. This arrangement provides significantly better methane to ethane ratio control in the NGL product, especially during major disturbances such as turbo-expander startups and failures. The system response time is greatly improved over those systems which depend in any manner on temperature controllers for control of the heat input to the fractionation column.

Other objects and advantages of the invention will be apparent from the detailed description of the invention and the appended claims as well as from the detailed description of the drawings in which:

Figure 1:
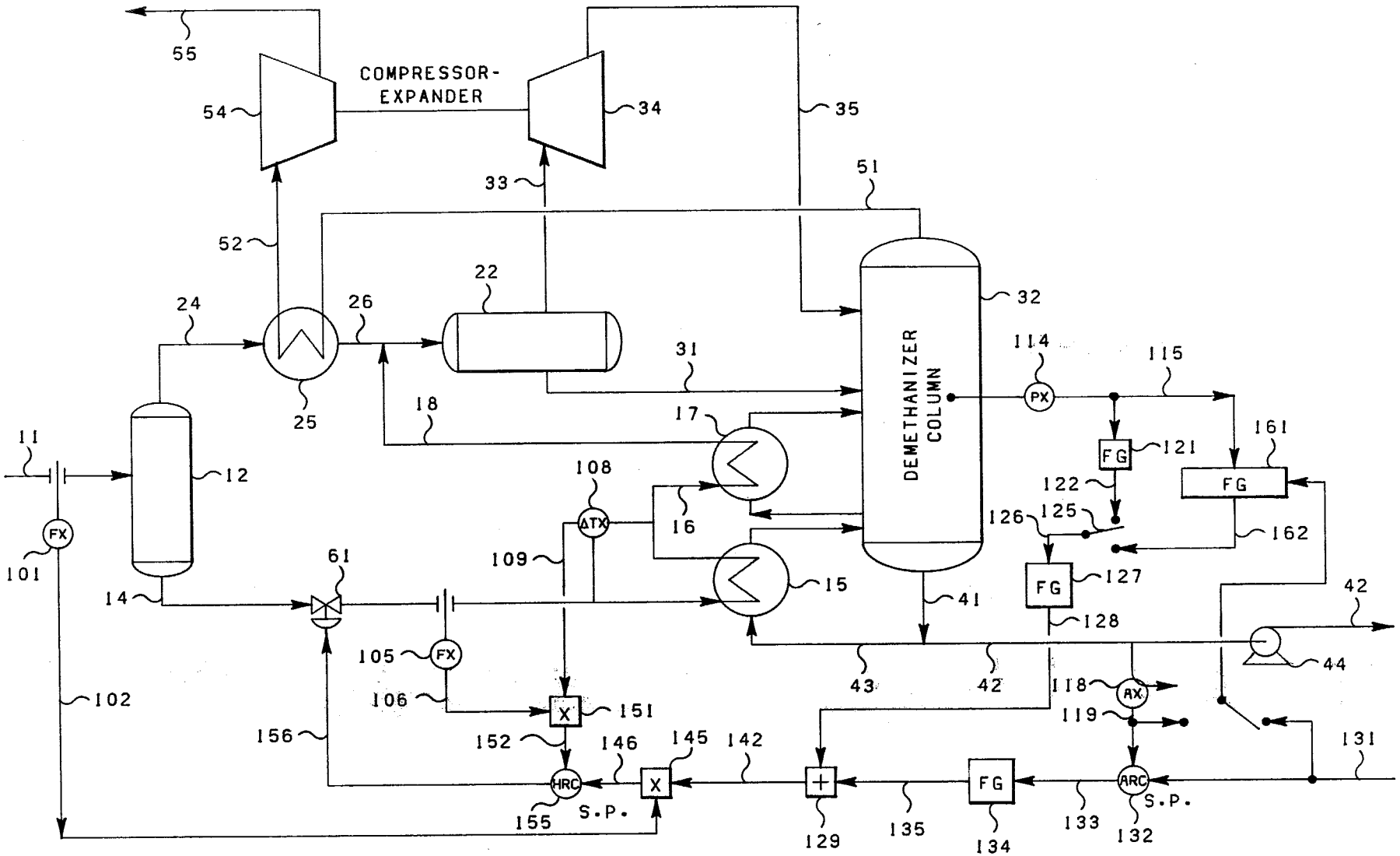
FIG. 1 is a schematic representation of a natural gas liquids recovery system implemented in accordance with the present invention.

Referring now to FIG. 1, there is illustrated a natural gas liquids recovery system wherein a feedstream of compressed raw natural gas is provided through a feed conduit 11 to a separation vessel 12. From the separation vessel 12 a liquid portion of the feedstream is passed through a liquid conduit means 14, a reboiler heat exchange means 15, a connecting circuit means 16, a column side heat exchange means 17 and a conduit means 18 to a second separation vessel 22. The gaseous feed material from the separator 12 is conveyed through a conduit means 24, a heat exchange means 25 and a conduit means 26 to the second separation vessel 22. The liquid feed material from the second separation vessel 22 is provided through a conduit means 31 as a liquid feedstream to a demethanizer column 32. The vapor portion of the material within the second separation means 22 is provided through a conduit means 33 to an expander means 34. The output of the expander means 34 is connected by a conduit means 35 to the demethanizer column 32 in order to provide the combined vapor and liquid-containing stream from the output of the expander 34 as a feedstream to the demethanizer column 32. A demethanizer column bottom conduit 41 delivers natural gas liquid product material from the bottom of the demethanizer column 32 to a bottom product conduit means 42 and to a reboiler conduit means 43. A portion of the bottom product of the demathanizer column 32 is therefore circulated through the reboiler heat exchange means 15 and returned to the demethanizer column 32 by the conduit means 43, and the remainder of the liquid bottom product is provided by the conduit means 42 as a natural gas liquid product. Suitable means for providing the desired flow of various streams associated with the process illustrated by FIG. 1 such as the pump means 44 located within the conduit means 42 are ordinarily provided as needed but have, in general, been omitted from the schematic drawing of FIG. 1 in the interest of ease of illustration. Similarly, other equipment may commonly be associated with the illustrated system to provide alternative operation during equipment outages such as a bypass conduit (not shown) for bypassing the expander 34 and connecting conduit 33 directly to conduit 35 in the event of an expander failure or malfunction.

The overhead vapor product of the demethanizer column 32 is provided by a conduit means 51 through the heat exchange means 25 and a conduit means 52 as an overhead product stream for use as appropriate. In many instances the gaseous product can be provided by a branch of the conduit means 52 as fuel for another portion of the process or a related process. Ordinarily at least a portion of the gaseous stream from the conduit means 52 is compressed by a suitable compressor means 54 which can be driven, for example, by the expander means 34 and a compressed overhead gas stream is delivered from the process by means of an overhead product conduit means 55.

In operation, the process illustrated in FIG. 1 is carried out at subambient temperatures. A typical temperature within the top portion of the demethanizer column 32, for example, would be about −150° F. (about −100° C.). The feed material entering the system through the feed conduit 11, therefore, will be at a relatively high temperature and can be utilized as a source of heat. The liquid portion of the feed material provided to the reboiler heat exchange means 15 and side heat exchanger 17 is therefore utilized as a source of heat to provide the desired operating characteristics within the demethanizer column 32 and, at the same time, the liquid feed material is cooled during its passage through the heat exchange means 15 and 17. The vapor feed material provided by the conduit means 24 to the heat exchange means 25 is cooled by providing heat to the overhead product material in the heat exchanger means 25. The effect of the expansion carried out within the expander means 34 provides substantial cooling and partial condensation of the gaseous material provided thereto. The energy removed from the gaseous material during this cooling step can be advantageously provided to the compressor means 54 by means of a direct mechanical linkage between the expander means 34 and the compressor means 54.

While a considerable amount of control equipment is ordinarily utilized in controlling a process such as the one schematically illustrated by FIG. 1, only that control equipment relevant to operation of the present invention is illustrated by FIG. 1. A flow transducing means 101 produces a feed flow signal 102 representative of the rate of flow of feed material through the conduit means 11 to the process. The flow transducer means 101 can be selected from a variety of equipment known in the art such as an orifice flowmeter and as other equipment hereinafter described, is considered to include any additional scaling or similar apparatus necessary to provide a flow rate signal 102 compatible with the other equipment utilized and suitable for use as hereinafter described. A valve means 61 located within the conduit means 14 is provided for controlling the flow rate of material through the conduit means 14. The flow rate of material through the conduit means 14 is measured by a flow transducer means 105 which delivers a flow rate signal 106 representative thereof. The temperature differential between the feed material entering the reboiler heat exchange means 15 and the feed material exiting the reboiler heat exchanger is measured by a temperature differential transducer means 108 which delivers a temperature differential signal 109 representative of the measured temperature difference. A pressure transducer 114 is adapted to deliver a column pressure signal 115 representative of the pressure at a pre-selected position within the demethanizer column 32. An analysis transducing means 118 is adapted to accept a sample of bottom product material from the bottom product conduit means 42 and to deliver an analysis signal 119 representative of the concentration of the components of interest in the bottom product stream. In particular, a preferred analysis transducer 118 produces an analysis signal 119 representative of the ratio of two preselected product constituents exiting the fractionation column as part of the bottom product stream. In the case of the illustrated natural gas liquids separation process, a preferred analysis transducing means 118 produces an analysis signal 119 representative of the ratio of methane to ethane within the bottom product.

The various transducing means used to measure parameters which characterize the process and the various signals generated thereby may take a variety of forms or formats. For example, the control elements of the system can be implemented utilizing electrical analog, digital electronic, pneumatic, hydraulic, mechanical or other similar types of equipment or combinations of one or more of such equipment types. While the presently preferred embodiment of the invention preferably utilizes a combination of pneumatic control elements such as a pneumatically operated valve means 61 in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flowmeter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. In addition, all signals could be translated into a "suppressed zero" or other similar format in order to provide a "live zero" and prevent an equipment failure from being erroneously interpreted as a low (or high) measurement or control signal. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

The pressure signal 115, representative of the pressure within the demethanizer column 32, is converted by a function generating means 121 to an equivalent temperature signal 122 representative of the bottom temperature within the demethanizer column 32 required to provide a preselected methane to ethane bottom product ratio at a preselected feed material composition. A switch means 125 selects from one or more equivalent temperature signals such as the signal 122 to provide a temperature requirement signal 126 representative of the temperature which must be maintained at the bottom of the demethanizer column in order to provide a demethanizer bottom product having a preselected methane to ethane ratio.

The temperature requirement signal 126 is supplied as an input to function generating means 127. The temperature requirement signal 126 is converted by function generating means 127 to an equivalent required heat signal 128 representative of the direction and magnitude of any change required in the heat input to the demethanizer column 32 required to maintain the bottom temperature within the demethanizer column 32 required to provide a preselected methane to ethane bottom product ratio at a preselected feed material composition. Signal 128 is provided as one input to summing means 129.

A bottom product set point signal 131 representative of the desired ratio of methane to ethane in the bottom product of the demethanizer column is provided as a set point signal to an analysis recorder-controller means 132 which produces temperature requirement adjustment signal 133 in response to the difference between the analysis set point signal 131 and the measured analysis signal 119. While the analysis recorder-controller can be any suitable control means known in the art, a preferred analysis recorder-controller means performs a control function ordinarily referred to by those skilled in the art as proportional-integral-derivative control wherein the controller response is of the general form $$S_0 = K_1 + K_2E + K_3dE/dt + K_4\int Edt$$

where $S_0$ is the controller output signal,

E is the error or difference between the set point signal and measurement signal provided to the controller, t is time, and $K_1$, $K_2$, $K_3$ and $K_4$ are constants.

Depending upon the particular control circumstances and requirements, one or more of the constants $K_1$, $K_2$, $K_3$ or $K_4$ can be zero.

The control function of the analysis recorder-control means 132 is chosen to provide as the output signal 133 thereof a correction signal which can be used to alter the required heat signal 128 to compensate for any difference which may exist between the measured methane to ethane ratio within the bottom product and the methane to ethane ratio upon which the conversion of column pressure to equivalent temperature by the function generating means 121 is based and upon which the conversion of required temperature to required heat is based. Although the methane to ethane ratio used in determining the function to be applied by the function generating means 121 and 127 and the methane to ethane ratio utilized as the bottom product set point signal 131 is preferably the same, adaptation of the analysis recorder-controller means 132 can be utilized to provide correction to the signal generated by the function generating means 127 even though the methane to ethane ratio represented by the set point signal 131 and the methane to ethane ratio used in determining the transfer function of the function generating means 127 may differ.

The required temperature adjustment signal 133 from the analysis recorder-controller means 132 is supplied as an input to function generating means 134. Signal 133 is converted by function generating means 134 to a required heat correction signal 135. Signal 135 is supplied as a second input to summing means 129 and is added to the required heat signal 128 to produce a corrected required heat signal 142. Signal 142 is multiplied by the feed flow rate signal 102 by multiplier means 145 to provide a heat flow set point signal 146 representative of the rate of heat flow to the demethanizer column reboiler required to maintain the demethanizer column bottom temperature which will provide a preselected methane to ethane bottom product ratio.

A multiplying means 151 multiplies the flow rate signal 106 representative of the liquid material flow to the bottom reboiler heat exchange means 15 by the temperature difference signal 109 representative of the temperature drop between the inlet and outlet conduits of the bottom reboiler heat exchange means 15 to obtain a measured heat flow signal 152 representative of the rate at which heat is being transmitted to the reboiler heat exchanger means 15. A heat recorder-controller means 155, in response to a comparison of the heat set point signal 156 to the actuating means of the valve 61 to initiate the change of position of the valve means 61 necessary to provide a heat flow rate specified by the heat set point signal 146.

While the use of a function generating means 121 responsive only to the column pressure signal 115 is presently preferred for its simplicity and adequacy in controlling a process, particularly a cryogenic natural gas liquids separation process, other function generating means such as the illustrated function generating means 161 responsive both to the column pressure signal 115 and to the bottom product analysis signal 119 or bottom product analysis set point signal 131 can be utilized to provide an alternative equivalent temperature signal 162. In a similar manner, where the composition of the feedstream to the process is subject to variation, analysis of that stream and inclusion of a feedstream analysis correction signal applied to the temperature requirement signal or incorporated into the function generated by a function generating means producing a temperature equivalent signal, could be utilized in appropriate cases.

In operation, the system illustrated by FIG. 1 manipulates the flow of heating fluid to the reboiler heat exchange means 15 in response primarily to the measurement of pressure within the demethanizer column 32. The column pressure signal 115 is converted directly to a temperature requirement signal 126. The temperature requirement signal 126 is then converted directly to a heat requirement signal 128 without the use of a temperature controller to compare the required temperature with the actual demethanizer column temperature. Since the column pressure signal 115 is converted directly to a required heat signal 128 without the use of a temperature controller, the system results in more responsive control of the demethanizer column 32.

The required heat signal 128 is also adjusted by the analysis recorder output signal 133 to compensate for differences between the actual measured bottom product constituent content and the desired bottom product constituent content used as the basis for the conversion of the column pressure signal to a required temperature signal. This is accomplished by utilizing function generating means 134 to convert the required temperature adjustment signal 133 directly to a required heat correction signal 135 and then summing the required heat signal 128 and the required heat correction signal 135. The continued use of the analysis recorder-controller to generate a correction signal insures that, even at operating conditions wherein the bottom product composition is substantially different from that assumed when selecting the characteristics of the function generating means 121 and 127 or when an unforeseen change in feed material composition to the process is encountered, the long-term control of the process will continue to be maintained to provide a desired bottom product composition.

Figure 2:
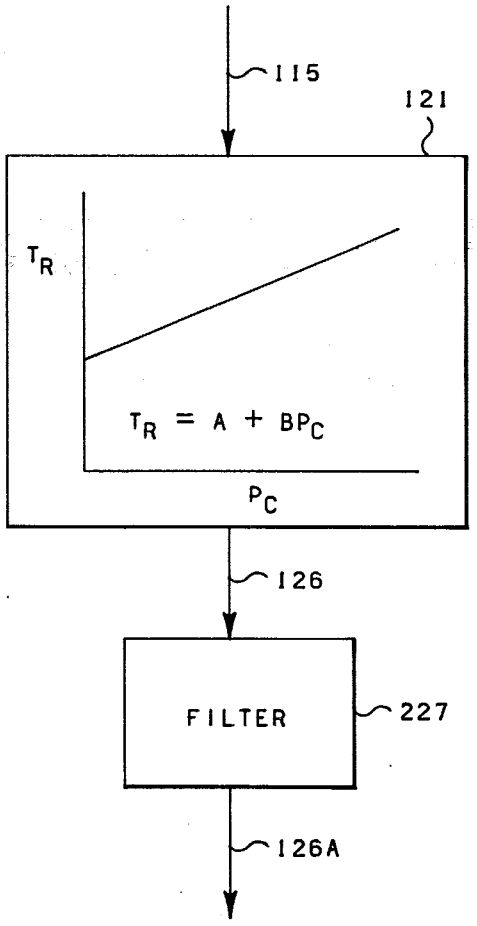
FIG. 2 is a particularly preferred embodiment of the function generator, illustrated in FIG. 1, utilized to convert the fractionation column pressure to the temperature requirement signal.

FIG. 2 illustrates a preferred implementation used in generating the temperature requirement signal 126 in accordance with the invention. The pressure signal 115 delivered by the pressure transducer means 114 is delivered to a particularly preferred function generating means 121 wherein the relationship between the measured pressure signal 115, $P_C$, and the temperature requirement signal 126, $T_R$, is as graphically illustrated in the block representing the function generating means 121 with the relationship being of the general form $$T_R = A + BP_C$$

where $T_R$ is the temperature requirement signal 126;

where $P_C$ is the measured column pressure signal 115; and where A and B are constants.

As previously indicated, the immediate conversion of the pressure signal 115 to a required temperature signal 126 is advantageous in permitting immediate alteration of the temperature set point signal without waiting for the pressure change to result in a change in measured bottom product analysis. However, in some systems unnecessary alteration of the temperature set point signal in response to transient pressure variations could result in unnecessary control changes or variations. For this reason it is preferred that the temperature requirement signal 126 be filtered using appropriate signal filtering means 227 in order to produce a more stable temperature requirement signal **126*a* signal which is less subject to unnecessary fluctuation based on insignificant fluctuations, transient fluctuations, or "noise" appearing in the pressure signal 115. Signal 126*a* is supplied to function generating means 127** as previously described.

Figure 3:
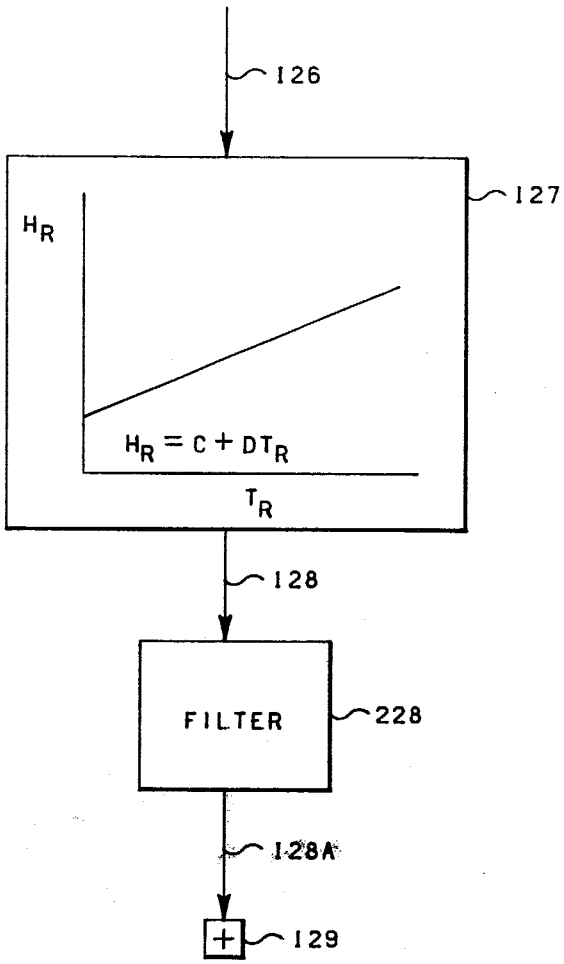
FIG. 3 is a particularly preferred embodiment of the function generator, illustrated in FIG. 1, utilized to convert the temperature requirement signal to a required heat signal.

FIG. 3 illustrates a preferred implementation in generating a required heat signal 128 in accordance with the present invention. The temperature requirement signal 126, which is the same as illustrated in FIG. 1, is transmitted to a particularly preferred function generating means 127 wherein the relationship between the temperature requirement signal 126, $T_R$, and the heat requirement signal 128, $H_R$, is as graphically illustrated in the block representing the function generating means 127 with the relationship being of the general form $$H_R = C + D\,T_R$$

where $H_R$ is the heat requirement signal 128;

$T_R$ is the temperature requirement signal 126; and

C and D are constants.

As previously indicated, the immediate conversion of the temperature requirement signal 126 to a required heat signal 128 is advantageous in immediate alteration of the heat input to the demethanizer column 32 is accomplished without the delay inherent in temperature controllers. However, in some systems the control system of the present invention could result in unnecessary alterations in the heat input to the demethanizer column due to transient pressure variations. For this reason it is preferred that the heat requirement signal 128 be filtered using appropriate signal filtering means 228 in order to produce a more stable heat requirement signal **128*a* which is less subject to unnecessary fluctuation based on insignificant fluctuations, transient fluctuations, or "noise" appearing in the temperature requirement signal 126. The filtered heat requirement signal 128*a* is supplied to summing means 129 as previously described for signal 128 in FIG. 1**.

Figure 4:
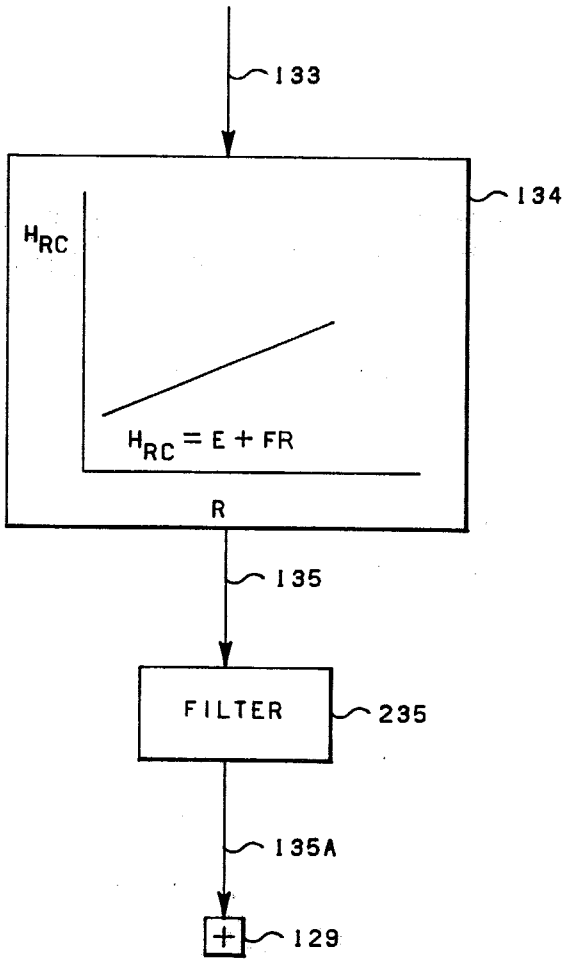
FIG. 4 is a particularly preferred embodiment of the function generator, illustrated in FIG. 1, utilized to convert the product analysis to a required heat correction signal.

FIG. 4 illustrates a preferred implementation in generating a required heat correction signal 135 in accordance with the present invention. Signal 133, which is the same as illustrated in FIG. 1, is delivered to a particularly preferred function generating means 134 wherein the relationship between the required heat correction signal 135, $H_{RC}$, and the signal 133, R, which in this preferred embodiment is the difference between the actual methane to ethane ratio in the bottom product and the desired methane to ethane ratio in the bottom product is as graphically illustrated in the block representing the function generating means 134 with the relationship being of the general form $$H_{RC} = G + FR$$

where $H_{RC}$ is the heat requirement correction signal 135;

R is representative of $E + K_1 \int E dt + K_2 (dE/dt)$ where E is representative of the difference between the actual methane to ethane ratio in the bottom product and the desired methane to ethane ratio in the bottom product and $K_1$ and $K_2$ are constants; and G and F are constants.

Signal 135 is in a preferred embodiment supplied to an appropriate signal filtering means 235 in order to produce a more stable required heat correction signal **135*a* which is less subject to unnecessary fluctuation based on insignificant fluctuations in the methane to ethane ratio in the bottom product. The filtered heat requirement correction signal 135*a* is supplied to summing means 129 as previously described for signal 135 in FIG. 1**.

As previously indicated, the nature of the correction applied to the heat requirement signal 128 or **128*a* to produce a suitable corrected heat requirement signal 142 could vary considerably and could be adapted to include multiplication by a correction factor or any of a variety of more complicated relationships. The preferred embodiment illustrated by FIG. 1 using a correction factor which is added to the heat requirement signal is presently preferred due to the unique relationship which has been discovered to exist between column pressure and column bottom temperature over the operating range of columns such as the fractionation column 32**. In this context, adding a correction factor is intended in its broadest algebraic sense and would obviously include subtraction of an appropriate bias signal as well as actual addition of a bias signal to the heat requirement signal.

Figure 5:
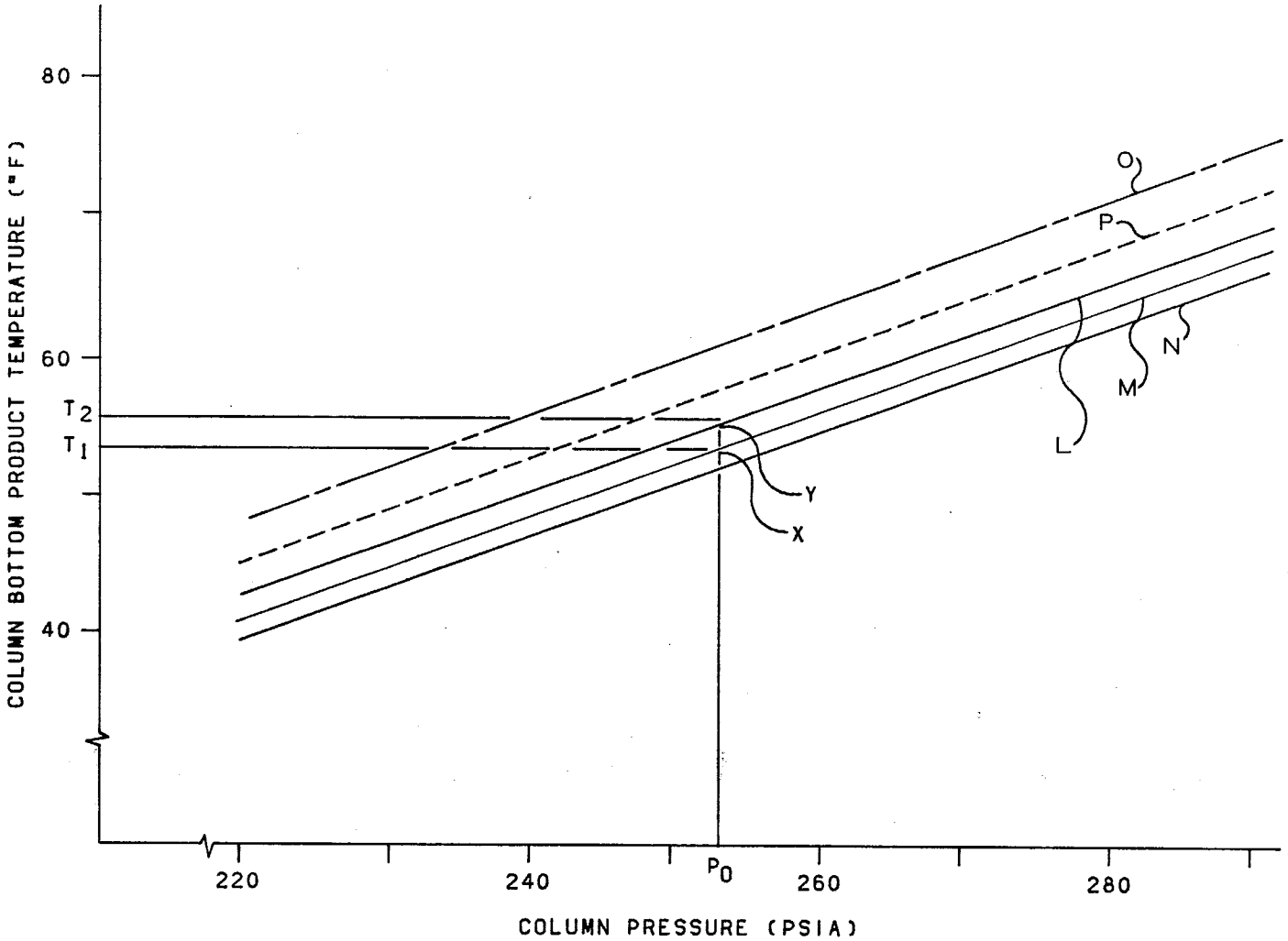
FIG. 5 is a graphical representation of a portion of the fractionating column temperature-pressure characteristic for a cryogenic demethanizer column under various operating conditions.

FIG. 5 illustrates the unique relationship between temperature and pressure for a demethanizer associated with a natural gas liquids separation process with typical pressures within the range of from about 220 psi (about 1520 kPa) to about 290 psi (about 2000 kPa) and column bottom temperatures within the range of from about 40° F. (4° C.) to about 80° F. (27° C.). Within these ranges of temperature and pressure the pressure to temperature relationships at constant column operating conditions and constant process feed composition is a generally straight line which can be defined by the equation $$T_R = A + BP_C$$

where $T_R$, $P_C$, A, and B are as previously defined. For variations in bottom product composition with process parameters other than pressure remaining substantially constant, a family of generally parallel straight line relationships is produced by the associated pressure-temperature relationships. For example, in FIG. 5, with a methane to ethane ratio of 0.025 the pressure-temperature relationship is illustrated by line L. For a methane to ethane ratio of 0.03, the relationship is illustrated by line M, and with a methane to ethane ratio of 0.0325, line N illustrates the pressure-temperature relationship. It can therefore be readily seen that for a constant bottom product methane to ethane ratio the temperature of the demethanizer column could be controlled solely by the measurement of column pressure and generation of the required heat signal determined by the pressure-temperature-heat relationship at the specified bottom product constituent ratio. Since bottom product constituent ratios will nearly always exhibit some variation in any practical system, the required heat correction signal 135 can be generated in response to analysis of the bottom product to provide a bias correction equivalent to the vertical distance between the pressure-temperature line for the column operating pressure at the preselected product constituent ratio used in selecting the pressure-temperature function generation characteristics and the generally parallel curve which characterizes the pressure-temperature characteristic at the measured bottom product constituent content. For example, assuming a measured column operating pressure of $P_0$ and a preselected methane to ethane ratio in the column bottom product of 0.03, the pressure-temperature characteristic implemented by the function generating means 121 is illustrated by line M of FIG. 5, and the temperature requirement signal 126 delivered by the function generating means 121 would be representative of $T_1$ of FIG. 5. If, however, the actual methane to ethane concentration in the bottom product as determined by the analysis transducer 118 and represented by the analysis signal 119 is 0.025, the correction signal 133 would be applied by adding to the signal representative of temperature $T_1$ to produce a temperature set point signal 136 representative of the temperature $T_2$ of FIG. 5. In a similar manner if the analysis signal 119 represented a measured bottom methane to ethane ratio of 0.0325, for example, a negative signal 133 would be "added" to the $T_1$ signal to produce an appropriate temperature set point signal representative of a temperature lower than $T_1$.

When the composition of the feed material provided to the separation process of FIG. 1 by the feed conduit means 11 changes, the family of characteristic pressure-temperature curves also changes. In general, there is a vertical shift in the pressure-temperature relationship as illustrated by FIG. 5. For example, lines M and O both represent the pressure-temperature relationship for the same system under generally the same operating conditions at a demethanizer bottom product methane to ethane concentration of 0.03 but with different feed material compositions provided to the process through the feed conduit means 11. In a similar manner, other process variables cause similar curve shifts. Using the same feed composition and demethanizer column methane to ethane ratio (0.03) as used to provide the pressure-temperature relationship of line M in FIG. 5, line P results if the expander 34 of FIG. 1 is not used. The condition represented by line P of FIG. 5 would be equivalent to an expander failure in which the expander is effectively removed from the system and bypassed. It can be readily understood that bias factors in addition to the correction factor 133 generated by the analysis recorder-controller 132 can be added to the control system in order to account for changes in feed composition, changes resulting from equipment outages, and other similar expected or unexpected process changes.

The relationship between the required temperature and the required heat input for the demethanizer is very similar to that described in FIG. 5 for the relationship between temperature and pressure. The straight line relationship is still present and the variation of the relationship with respect to the methane to ethane ratio is the same as that illustrated in FIG. 5.

The relationship between the required heat correction signal and the difference between the actual and desired methane to ethane ratiio will not vary as a family of curves once the relationship is established for a particular system. The relationship will remain as a single straight line curve because a differential methane to ethane ratio is involved.

The location at which column pressure is measured may, in some cases, have some effect on the location of the characteristic pressure-temperature relationship for a particular column. This is caused by the fact that some pressure drop, usually a relatively small pressure drop, is observed across some fractionation columns. Other columns may operate at a generally uniform pressure throughout. While measurement of column pressure in the bottom portion of the column will provide the most direct determination of the pressure with which the pressure-temperature relationship is concerned, measurement at any preselected, convenient location within the column is satisfactory and can be utilized with a slight adjustment, if necessary, of the characteristic pressure-temperature curves to account for any pressure difference between the point of measurement and the bottom of the column which may be characteristic of the particular column.

While the invention has been discussed and illustrated in conjunction with a preferred embodiment wherein the pressure-temperature relationship and the temperature-heat relationship wtihin the fractionating column can be expressed by a family of generally parallel straight line curves and the heat-product constituent ratio can be expressed as a single straight line curve, the apparatus and method of the invention are equally applicable to columns in which the pressure-temperature relationship and/or the temperature-heat relationship is curved rather than straight or is characterized by a family of curves defined by a more complicated relationship. The invention is also equally applicable to columns where the heat-product constituent ratio is a curved line. Available equipment such as the variable diode function generator disclosed by U.S. Pat. No. 3,549,998 can be utilized to provide function generating means 121, 127, and 134 which can implement a variety of relationships in order to immediately translate the measuring column pressure signal and the product analysis signal to a corrected required heat signal.

Although any suitable equipment can be utilized in implementing the apparatus and method of the invention, particularly preferred apparatus for use in conjunction with a low-temperature natural gas liquid demethanizing column is as follows:

| | |
|---|---|
| Flow transducer 101 | Electrically operated differential pressure cell connected to Foxboro Dynalog recorder-controller sold by the Foxboro Corp., Foxboro, Mass. |
| Flow transducer 105 | Electrically operated differential pressure cell connected to Foxboro Dynalog recorder-controller sold by the Foxboro Corp., Foxboro, Mass. |
| Pressure transducer 114 | Foxboro-Baldwin fluid pressure cell connected to a Foxboro Dynalog recorder-controller |
| Analysis transducer 118 | Model 214 process chromatographic analyzer sold by Applied Automation, Inc., Bartlesville, OK 74004 |
| Function generator 121, 127 134 | Applied Automation No. B03983 sold by Applied Automation, Inc. Bartlesville, OK 74004 |
| Recorder-controller 132, 141 and 155 | P. I. Controller AAI component No. B03979 and derivative feedback sold by Applied Automation, Inc., Bartlesville, OK 74004 |
| Adder 129 | Applied Automation, Inc. No. B05885, |

-continued

| | |
|---|---|
| | multiuse amplifier |
| Multiplier 145 and 151 | Model 4029/25 Multiplier sold by Burr-Brown Corp., Tucson, Ariz. 85706 |
| Filter 227, 228 and 235 | Applied Automation No. B03989 sold by Applied Automation, Inc. Bartlesville, OK 74004 |

In addition to the various control system modifications which will be apparent to those skilled in the art in view of applicant's disclosure and claims, the apparatus and method of the invention are useful in a variety of process applications and in conjunction with a variety of process configurations. For example, the control of heat to the reboiler 15 of FIG. 1 is applicable to any heat source or heat stream which may be utilized, and although the invention is particularly useful in the control of cryogenic fractionation processes, it can be equally useful for any fractionation process in which fluctuation in temperature capable of having a significant effect on column product composition will be encountered. In addition, other variations and modifications by those skilled in the art are considered to be within the scope of the foregoing specification and of the claims appended hereto.

That which is claimed is:

1. Apparatus comprising:

fractionation column means for receiving at least one feed material stream and delivering an overhead product stream from the top portion thereof and a bottom product stream from the bottom portion thereof;

heating means for providing heat to said bottom portion of said fractionation column means;

pressure transducer means for sensing the pressure at a preselected location within said fractionation column means and delivering a column pressure signal representative of the thus sensed pressure;

a first signal conversion means for accepting said column pressure signal and delivering in response thereto a temperature requirement signal representative of the value of a column bottom temperature for said fractionation column means required to provide a preselected value of a constituent ratio in said bottom product stream at the column pressure represented by said column pressure signal;

a second signal conversion means for accepting said temperature requirement signal and delivering in response thereto a heat requirement signal representative of the direction and magnitude of the change in heat input to said fractionation column means required to provide the column bottom temperature for said fractionation column means required to provide said preselected value of said constituent ratio in said bottom product stream at the column pressure represented by said column pressure signal;

analyzer means for analyzing said bottom product stream and delivering an analysis signal representative of the analyzed value of said constituent ratio in said bottom product stream;

analysis controller means for delivering, in response to a comparison of said analysis signal with a constituent ratio set point signal, a temperature requirement adjustment signal representative of the adjustment of said temperature requirement signal necessary to compensate for the difference between said preselected value of said constituent ratio and the analyzed value of said constituent ratio;

a third signal conversion means for accepting said temperature requirement adjustment signal and delivering in response thereto a required heat correction signal representative of the adjustment of said required heat signal necessary to compensate for the difference between said preselected value of said constituent ratio and the analyzed value of said constituent ratio;

a correction means for applying said required heat correction signal to said required heat signal to produce a corrected required heat signal; and means for controlling the amount of heat flow delivered to said bottom portion of said fractionation column means by said heating means in response to said corrected required heat signal.

2. Apparatus in accordance with claim 1 wherein said first signal conversion means comprises means for simulating the relationship between said column pressure signal and said temperature requirement signal for said preselected value of said constituent ratio in said bottom product stream.

3. Apparatus in accordance with claim 2 wherein said second signal conversion means comprises means for simulating the relationship between said temperature requirement signal and said heat requirement signal for said preselected value of said constituent ratio in said bottom product stream.

4. Apparatus in accordance with claim 3 wherein said third signal conversion means comprises means for simulating the relationship between said temperature requirement adjustment signal and said required heat correction signal.

5. Apparatus in accordance with claim 4 wherein said first signal conversion means, said second signal conversion means and said third signal conversion means comprise diode function generators.

6. Apparatus in accordance with claim 2 wherein said first signal conversion means is adapted to provide a temperature requirement signal which fulfills the general condition:

$$T_R = A + BP_c$$

where $T_R$ is said temperature requirement signal, $P_c$ is said column pressure signal, and A and B are constants.

7. Apparatus in accordance with claim 3 wherein said second signal conversion means is adapted to provide a required heat signal which fulfills the general condition:

$$H_R = C + DT_R$$

where $H_R$ is said required heat signal, $T_R$ is said temperature requirement signal, and C and D are constants.

8. Apparatus in accordance with claim 4 wherein said third signal conversion means is adapted to provide a required heat correction signal which fulfills the general condition:

$$H_{RC} = G + FR$$

where $H_{RC}$ is said required heat correction signal, R is said temperature requirement adjustment signal, and G and F are constants.

9. Apparatus in accordance with claim 1 wherein said correction means comprises means for adding said required heat signal and said required heat correction signal to produce said corrected required heat signal.

10. Apparatus in accordance with claim 1 wherein said fractionation column means comprises a demethanizer column of a cryogenic natural gas separation plant.

11. Apparatus in accordance with claim 10 wherein said constituent ratio in said bottom product stream comprises the methane to ethane ratio of said bottom product stream, wherein said constituent ratio set point signal comprises a signal representative of a desired methane to ethane ratio, and wherein said analyzer means is adapted to deliver an analysis signal representative of the actual methane to ethane ratio of said bottom product stream.

12. Apparatus in accordance with claim 11 wherein said first signal conversion means comprises means for simulating the relationship between said column pressure signal and said temperature requirement signal for said preselected value of said methane to ethane ratio in said bottom product stream.

13. Apparatus in accordance with claim 12 wherein said second signal conversion means comprises means for simulating the relationship between said temperature requirement signal and said heat requirement signal for said preselected value of said methane to ethane ratio in said bottom product stream.

14. Apparatus in accordance with claim 13 wherein said third signal conversion means comprises means for simulating the relationship between said temperature requirement adjustment signal and said required heat correction signal.

15. Apparatus in accordance with claim 14 wherein said first signal conversion means is adapted to provide a temperature requirement signal which fulfills the general condition:

$$T_R = A + BP_c$$

where $T_R$ is said temperature requirement signal, $P_c$ is said column pressure signal, and A and B are constants.

16. Apparatus in accordance with claim 15 wherein said second signal conversion means is adapted to provide a required heat signal which fulfills the general condition:

$$H_R = C + DT_R$$

where $H_R$ is said required heat signal, $T_R$ is said temperature requirement signal, and C and D are constants.

17. Apparatus in accordance with claim 16 wherein said third signal conversion means is adapted to provide a required heat correction signal which fulfills the general condition:

$$H_{RC} = G + FR$$

where $H_{RC}$ is said required heat correction signal, R is said temperature requirement adjustment signal, and G and F are constants.

18. Apparatus in accordance with claim 17 wherein said correction means comprises means for adding said required heat signal and said required heat correction signal to produce said corrected required heat signal.

19. A method for operating a fractionation column, said method comprising the steps of:

providing at least one feed material stream to said fractionation column;

recovering an overhead product stream from the top portion of said fractionation column;

recovering a bottom product stream from the bottom portion of said fractionation column;

generating a column pressure signal representative of the pressure at a preselected location within said fractionation column;

generating, in response to said column pressure signal, a temperature requirement signal representative of the value of said column bottom temperature required to provide a preselected value of a constituent ratio in said bottom product stream at the column pressure represented by said column pressure signal;

generating, in response to said temperature requirement signal, a required heat signal representative of the direction and magnitude of the change in heat input to said fractionation column required to provide the column bottom temperature required to provide said preselected value of said constituent ratio in said bottom product stream at the column pressure represented by said column pressure signal;

generating an analysis signal representative of said constituent ratio in said bottom product stream;

generating in response to said analysis signal a required heat correction signal representative of the adjustment of said required heat signal necessary to provide said preselected value of said constituent ratio in said bottom product stream at the column pressure represented by said column pressure signal;

generating, in response to said required heat signal and said required heat correction signal, a corrected required heat signal; and manipulating the flow of heat to the bottom portion of said fractionation column in response to said corrected required heat signal.

20. A method in accordance with claim 19 wherein said step of generating said required heat correction signal comprises:

generating, in response to said analysis signal, a temperature requirement adjustment signal representative of the adjustment of said temperature requirement signal necessary to compensate for the difference between the analyzed constituent ratio of said bottom product stream and said preselected bottom product constituent ratio; and generating, in response to said temperature requirement adjustment signal, said required temperature correction signal.

21. A method in accordance with claim 19 wherein said temperature requirement signal fulfills the general condition:

$$T_R = A + BP_c$$

where $T_R$ is said temperature requirement signal, $P_c$ is said column pressure signal, and A and B are constants.

22. A method in accordance with claim 21 wherein said heat requirement signal fulfills the general condition:

$$H_R = C + DT_R$$

where $H_R$ is said heat requirement signal, $T_R$ is said temperature requirement signal, and C and D are constants.

23. A method in accordance with claim 22 wherein said required heat correction signal fulfills the general condition:

$$H_{RC}=G+FR$$

where $H_{RC}$ is said required heat correction signal, R is said temperature requirement adjustment signal, and G and F are constants.

24. A method in accordance with claim 19 wherein said step of generating said corrected required heat signal comprises adding said required heat signal and said required heat correction signal to produce said corrected required heat signal.

25. A method in accordance with claim 19 wherein said analysis signal comprises a methane to ethane ratio signal and wherein said preselected bottom product composition comprises a composition characterized by a preselected methane to ethane ratio.

26. A method in accordance with claim 20 wherein said analysis signal comprises a methane to ethane ratio signal and wherein said preselected bottom product composition comprises a composition characterized by a preselected methane to ethane ratio.

27. A method in accordance with claim 26 wherein generating said temperature requirement adjustment signal comprises comparing said analysis signal with an analysis set point signal representative of a desired methane to ethane ratio in said bottom product stream and generating said temperature requirement adjustment signal in response to said comparison.

28. A method in accordance with claim 27 wherein the methane to ethane ratio represented by said analysis set point signal is the same as said preselected methane to ethane ratio.

29. A method in accordance with claim 19 wherein said step of manipulating the flow of heat to the bottom of said fractionation column comprises:

combining said corrected required heat signal with a feed flow rate signal representative of the total flow rate of feed material to said fractionation column to produce a heat flow set point signal representative of the desired flow rate of heat to the bottom of said fractionation column;

generating a heat delivery signal representative of the measured rate of heat flow to the bottom of said fractionation column; and manipulating the flow rate of a heat-containing fluid to heat exchanger means associated with the bottom of said fractionation column in response to a comparison of said heat flow set point signal with said heat delivery signal to provide a flow of heat to the bottom portion of said fractionation column represented by said heat flow set point signal.

30. A method in accordance with claim 29 wherein said heat-containing fluid comprises at least a portion of the total feed material provided to said fractionation column.

* * * * *